United States Patent [19]

Cattaneo

[11] Patent Number: 5,052,847

[45] Date of Patent: Oct. 1, 1991

[54] FIXING PLATE FOR CONCEALED DEVICES USED FOR WALL-MOUNTING AN ITEM OF WALL FURNITURE

[75] Inventor: Carlo Cattaneo, Figino Serenza, Italy

[73] Assignee: Camar S.p.A., Figino Serenza, Italy

[21] Appl. No.: 495,342

[22] Filed: Mar. 19, 1990

[30] Foreign Application Priority Data

Mar. 20, 1989 [IT] Italy ..... 19824 A/89

[51] Int. Cl.[5] ..... F16B 12/46

[52] U.S. Cl. ..... 403/231; 248/225.1

[58] Field of Search ..... 248/300, 225.1, 222.1; 403/403, 382, 231

[56] References Cited

U.S. PATENT DOCUMENTS

| | | | |
|---|---|---|---|
| 2,520,231 | 8/1950 | Anderson | 403/231 |
| 2,912,013 | 11/1959 | Freyholdt et al. | 403/382 |
| 4,032,242 | 6/1977 | Morris | 403/231 |

*Primary Examiner*—Robert L. Wolfe

*Attorney, Agent, or Firm*—Hedman Gibson Costigan & Hoare

[57] ABSTRACT

A fixing plate for concealed devices used for wall-mounting an item of wall furniture comprises on at least one side a box section having pairs of holes for fixing screws which are aligned on an axis which intersects at least one wall of the furniture item in a non-perpendicular manner. Preferably, said plate comprises respective triangular box sections on its opposing vertical sides and on its upper horizontal side, said holes being provided at the base and vertex of the triangle respectively.

3 Claims, 2 Drawing Sheets

FIXING PLATE FOR CONCEALED DEVICES USED FOR WALL-MOUNTING AN ITEM OF WALL FURNITURE

This invention relates to an improved fixing plate for concealed devices used for wall-mounting an item of wall furniture, preferably but not necessarily a kitchen cabinet.

To wall-mount an item of wall furniture it is known to the expert of the art to use concealed devices in which a coupling element is articulatedly secured to a frame or plate in such a manner as to be adjustable in position relative to said plate.

The plate is fixed to the side and possibly also to the top panel of the item of furniture to the rear of the back panel, the coupling element being freely engaged with a bar or hook plugs fixed into the wall, or with some other object suitable for the purpose.

The aforesaid mounting devices are also provided with linkages comprising adjustment screws by which the height and/or depth of the coupling element relative to the plate can be adjusted.

Said adjustment screws are accessible from the interior of the furniture item through one or more apertures provided in the back panel.

By this means the position of the item of wall furniture can be adjusted within certain limits in terms of its depth and height after it has been coupled to the wall by engaging the coupling elements of the devices fixed to the sides of the furniture item, with the bar or hooks fixed to the wall.

Mounting devices of the aforesaid briefly described type are described and illustrated for example in German patents 2,717,169, 3,036,984 and 3,111,357, to which reference should be made if further clarification is required on the state of the art in this specific field.

One of the most important technical problems to be solved in constructing such devices relates to the configuration of the plate, which should be such as to allow it to be fixed to the furniture item in the most reliable and rapid manner possible, with no possibility of its subsequent separation and the serious dangers consequent thereon, the space available for housing the plate being always very small (normally of the order of 15 mm). In this respect, said plates are screwed to the side and/or top panel (top) of the furniture item behind the back panel, on an edge section of the side or top which besides being relatively narrow is also weakened by the presence of the groove housing the edge of the back panel.

The overall object of the present invention is to solve the aforeside technical problem in a satisfactory manner by providing a plate having a configuration such as in every possible situation to ensure that it is correctly and reliably fixed to the furniture item.

This object is attained according to the invention be a fixing plate for concealed devices used for wall-mounting an item of wall furniture, characterised by comprising on at least one side a box section having pairs of holes 23, 24 for fixing screws 25 which are aligned on an axis which intersects at least one wall of the furniture item in a non-perpendicular manner.

Preferably, said plate comprises respective box sections on its opposing vertical sides and on its upper horizontal side.

Preferably, said box section is triangular, said holes being provided at the base and vertex of the triangle respectively.

The structural and functional characteristics of the invention and its advantages compared with the known art will be more apparent from the description given hereinafter with reference to the accompanying drawings, which show an example of a fixing plate incorporating the principles of the invention. In the drawings.

Figure 1:
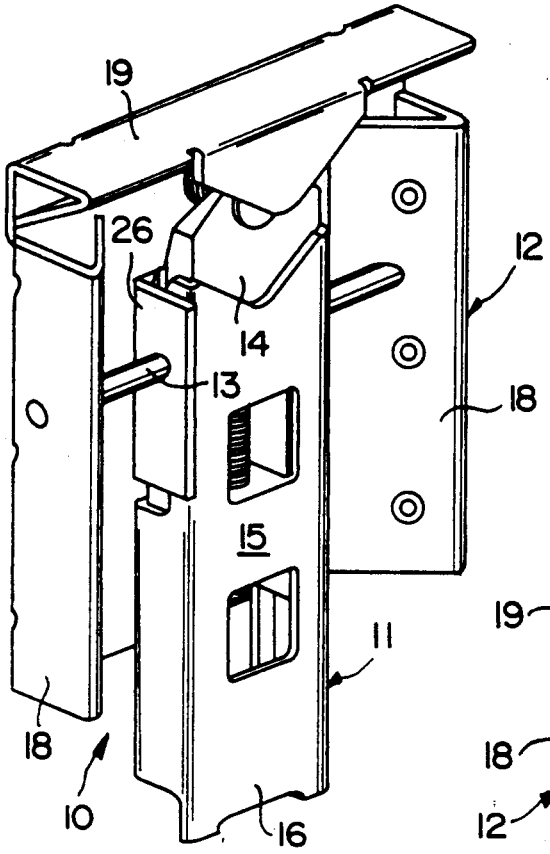
FIG. 1 is a perspective view showing one example of a concealed device for wall-mounting a furniture item provided with a fixing plate according to the invention.

The mounting device shown on the drawings is indicated overall by 10 and is structurally formed by combining a coupling module 11 with a plate 12. In the illustrated example a single pin 13 connects the module 11 articulatedly to the plate 12. The module 11 is composed of a core 14 which is partly surrounded by an outer box casing 15 which by a projecting end 16 defines the actual element which couples the device to a bar 17 fixed to the wall, or to another equivalent support.

The module 11, illustrated by way of non-limited example, forms the subject of the copending patent application filed on the same date by the present applicant.

The plate 12 of the invention could obviously also be used with other coupling modules of different structure and configuration from that of the module 11, which as stated is here illustrated by way of non-limiting example and only briefly described.

Figure 3:
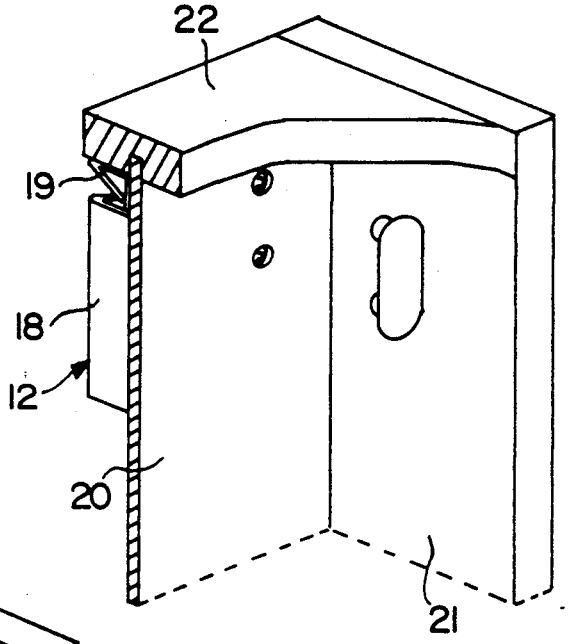
FIG. 3 shows the furniture item of FIG. 2 seen from the inside.
Figure 2:
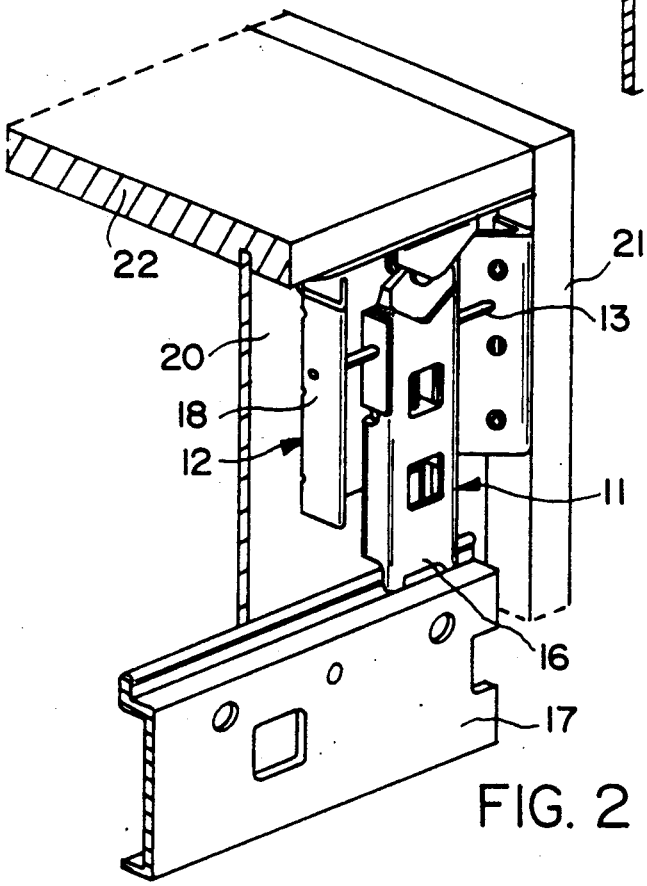
FIG. 2 is a perspective view of the device of FIG. 1 fixed to an item of wall furniture of which only a partial rear view is shown.
Figure 4:
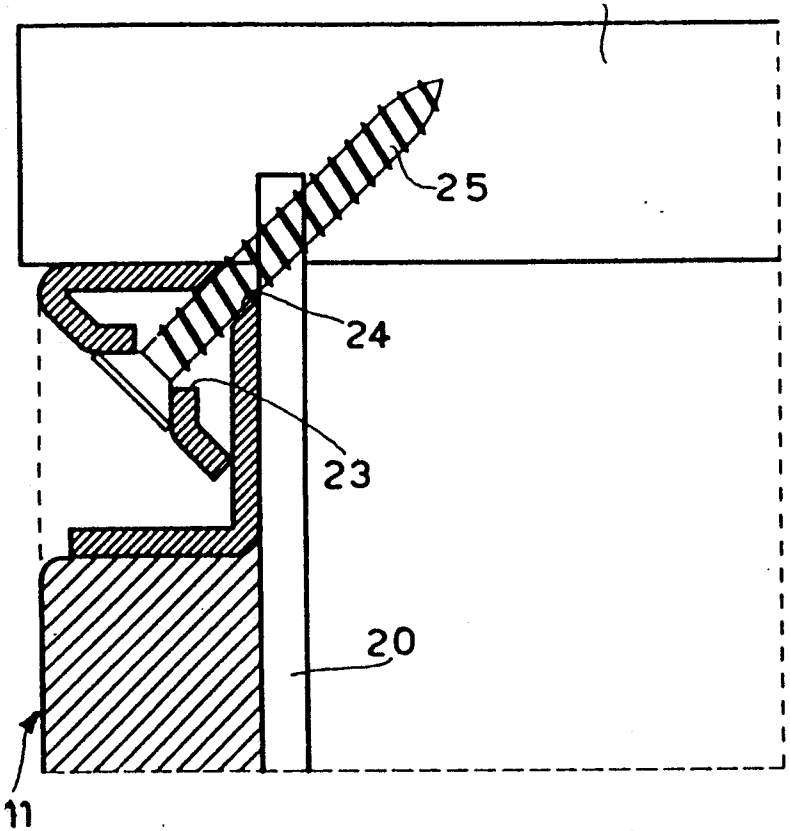
FIG. 4 is an enlarged section showing the configuration characteristic of the fixing plate and the oblique path of the screws through the walls of the furniture item.

Characteristically, the plate 12 comprises on three sides (the two vertical and the upper horizontal) respective triangular box sections 18 and 19 formed by bending the sheet metal inwards. Said sections 18 and 19 not only stiffen the system but also automatically ensure correct fixing of the device to the furniture item, as shown in FIGS. 2–4.

For this purpose the sections 18 and 19 each form a triangle having one side of length substantially equal to the distance between the back panel 20 and the free edge of the side 21 and top 22 of the furniture item. In this manner the device 10 becomes located exactly within the corner formed by the walls 20, 21 and 22 as seen in FIGS. 2 and 3 of the drawings, or at least between the walls 20, 21.

Correct and reliable fixing of the device to the furniture item is ensured by the provision of pairs of aligned holes 23 and 24 provided respectively at the base and at the vertex of said triangular sections 18 and 19. In this manner, as shown in FIG. 4, the fixing screws 25 inserted through said aligned holes 23 and 24 are compelled to screw diagonally through the side 21 or top 22, and also possible through the back panel 20.

The oblique fixing screws 25 thus engage a considerable overall section of the panels 21 or 22, to ensure stable and reliable fitting of the device to the item of wall furniture even under the worst conditions.

In this respect, compared with a screw 125 inserted perpendicularly to the panels as in the case of known devices (FIG. 6), the oblique arrangement of the screws 25 of the invention (FIG. 5) provides two advantages.

Figure 5:
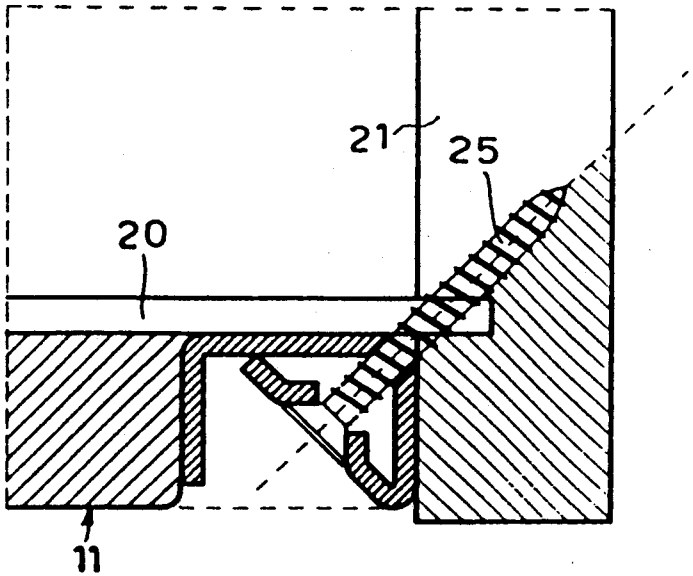
FIGS. 5 and 6 are two sections as in FIG. 4, which compare the fixing system of the invention with the known art.
Figure 6:
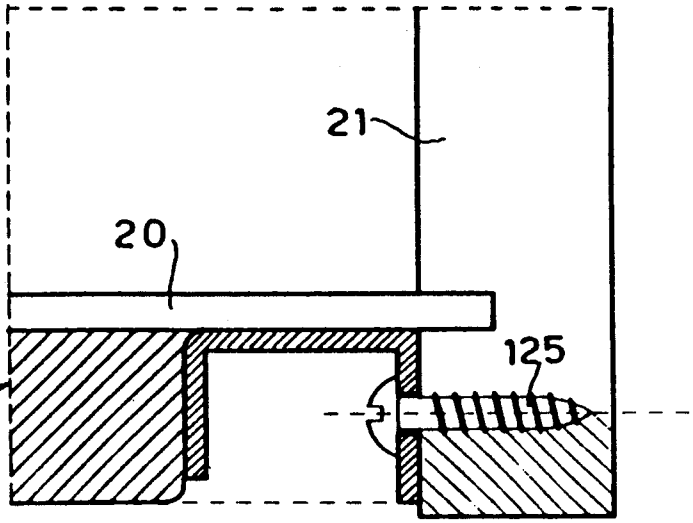

Firstly, the amount of material which opposes tearing-through of the screw is greater, as indicated by the hatched part of FIG. 5 and 6. Secondly the screw, being oblique to the panel, can be inserted to a greater depth and thus screw into more material. The plate 12 shown in FIG. 1 also comprises a central pair of fins 26 for containing and guiding the coupling module 11, which is telescopic as explained in the copending patent application of the present applicant.

Said fins 26 could obviously be dispensed with if the plate 12 is used in combination with a module 11 of different structure and configuration.

The initially defined object of the invention is therefore attained.

I claim:

1. A plate having opposing vertical sides and upper and lower horizontal sides for mounting a fixture on a wall, comprising a box section attached to the opposing vertical sides and to the upper horizontal side of the plate, wherein each of said sides of the plate is attached to the fixture through at least a pair of holes through said box section and oblique to the fixture.

2. The plate of claim 1, wherein said box section has a triangular cross section having a base and a vertex with said pair of holes therethrough.

3. The plate of claim 1 further comprising a pair of fins extending from said plate adapted for guiding the mounting of the fixture on the wall.

* * * * *